US006895193B2

(12) United States Patent
Takamatsu et al.

(10) Patent No.: US 6,895,193 B2
(45) Date of Patent: May 17, 2005

(54) IMAGE FORMING APPARATUS AND METHOD FOR ESTIMATING THE AMOUNT OF TONER CONSUMPTION

(75) Inventors: Ryuichiro Takamatsu, Osaka (JP); Yoshinori Senju, Saga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 34 days.

(21) Appl. No.: 10/460,663

(22) Filed: Jun. 13, 2003

(65) Prior Publication Data

US 2004/0042805 A1 Mar. 4, 2004

(30) Foreign Application Priority Data

Jun. 20, 2002 (JP) ..... 2002-179575
Sep. 19, 2002 (JP) ..... 2002-272531

(51) Int. Cl.[7] ..... G03G 15/00; G03G 15/08
(52) U.S. Cl. ..... 399/27; 347/131
(58) Field of Search ..... 399/27, 53, 255, 399/258; 347/18, 86, 131; 358/504, 406

(56) References Cited

U.S. PATENT DOCUMENTS 5,959,656 A * 9/1999 Dhong et al. ..... 347/131 X
6,072,510 A * 6/2000 Ogletree et al. ..... 347/131
6,516,160 B1 * 2/2003 Rodriguez ..... 399/27
6,687,467 B2 * 2/2004 Katoh ..... 399/27 X

FOREIGN PATENT DOCUMENTS

JP 58-224363 12/1983
JP 10-239978 9/1988
JP 10-133466 * 5/1998

* cited by examiner

*Primary Examiner*—Sophia S. Chen
(74) *Attorney, Agent, or Firm*—McDermott Will & Emery LLP

(57) ABSTRACT

An image forming apparatus and toner-consumption-estimation method that can accurately estimate the amount of consumed toner regardless of the type of image. A printing-pixel-counting unit counts from input image data the number of printing pixels. Also, an edge-counting unit similarly counts from the input image data the number of edges being boundaries between the printing pixels and blank pixels. A consumption-estimation unit then calculates the amount of consumed toner based on the counted number of printing pixels and the number of edges.

13 Claims, 13 Drawing Sheets

| | | | | | |
|---|---|---|---|---|---|
| −1 | 2 | −1 | 0 | 0 | 0 |
| −1 | 1 | 0 | 1 | −2 | 2 |
| 0 | 0 | −1 | 2 | −1 | 0 |

Fig. 12A

| | | |
|---|---|---|
| 0 | 0 | c |
| 0 | 1 | f |
| g | h | i |

Fig. 12B

| | | |
|---|---|---|
| a | 0 | 0 |
| d | 1 | 0 |
| g | h | i |

Fig. 12C

| | | |
|---|---|---|
| a | b | c |
| 0 | 1 | f |
| 0 | 0 | i |

Fig. 12D

| | | |
|---|---|---|
| a | b | c |
| d | 1 | 0 |
| g | 0 | 0 |

IMAGE FORMING APPARATUS AND METHOD FOR ESTIMATING THE AMOUNT OF TONER CONSUMPTION

BACKGROUND OF THE INVENTION

1. Field of the Invention

This invention relates to an image forming apparatus using electrophotographic process, and a method of estimating the amount of toner consumed by that image forming apparatus.

2. Description of the Related Art

In the developer of an image forming apparatus using electrophotographic process, a two-component developing agent consisting mainly toner particles (carbon particles, etc.) and carrier particles, is typically used. For example, in the case of an image forming apparatus that uses the two-component developing agent, the toner particles are consumed in the developer when forming an image, and the density of the toner with respect to the carrier particles, or in other words, the toner density decreases. In order to maintain the image quality, it is necessary for the toner density to be constant, and therefore it is necessary to supply toner particles periodically as the amount of toner particles decreases in order that the toner density remains constant. A magnetic permeability sensor is often used as a toner-density-measurement means of measuring the density of the toner particles. As the amount of toner particles decreases the magnetic permeability becomes high, or in other words, the magnetic permeability sensor detects magnetic permeability, and as a result detects a decrease in the amount of toner particles.

Since the sensor is expensive, a method of estimating the amount of toner particles consumed is used as a means of detecting the toner density without using this kind of sensor. A method of estimating the amount of toner particles consumed is disclosed in Japanese laid-open publication No. S58-224363, in which the individual pixel signals that make up the printing pixels when the image is formed are counted, and since the count is proportional to the amount of toner particles consumed, the amount of consumed toner is found from that ratio. The printing pixels referred to here are the pixels to which toner particles should be adhered.

However, as described in the publication mentioned above, the actual amount of consumed toner increases as the number of printing pixels increases, and the amount of consumed toner is not strictly proportional to the number of pixels. Depending on the type of image, the amount of consumed toner may differ even when the number of pixel to which the toner adheres is the same. For example, the amount of consumed toner per one pixel tends to become larger in line images than in solid images for which a specific area is filled in.

More particularly, in the case of the example of the printing surface having 4×4 pixels as shown in FIG. 3A, when toner is made to adhere (be fixed) to a square-shaped pixel 302, the toner adheres to the pixel in a circular shape 301 or elliptical shape. This is because that when filling in the image, it is necessary to have toner adhere to a contact point 304 between the pixels that come in contact in the diagonal direction (in other words, point-contacting pixels) 303. When the toner is adhered to an area smaller than the size of the pixel, the area around the contact point 304 is not sufficiently filled in.

Since the toner is adhered to an area larger than the size of the pixel, there are four leaf-shaped overlapping areas 305 when four pixels are filled in as shown in FIG. 3B, for example. Therefore, the amount of consumed toner does not become twice the amount as when filling in the two pixels shown in FIG. 3A, and results in an error in the amount of consumed toner. Also, in the case where toner is adhered to just one pixel 307 (isolated pixel) without adhering toner to the surrounding pixels as shown in FIG. 3C, it is generally known that the area to which toner adheres 308 is less than the area of the pixel 307. This is because in the exposure process of removing the electric charge from the portion where light comes in contact with the photosensitive drum, the time that the light goes ON/OFF is very short, so the charge cannot be sufficiently removed. The isolated pixel is also a factor in causing large error in the amount of consumed toner.

Error-removal processing for doing away with the difference between the estimated amount of consumed toner and the actual amount of consumed toner is actually performed a few times on several pages of printing. This error-removal processing is a process in which a specified pattern form measuring the density is printed internally, and the amount of consumed toner is adjusted by optically measuring the density of the printing.

However, when performing the error-removal process, there is a problem in that the printing process must be stopped, and particularly when the error-removal process is performed frequently, the number of printed pages per unit time, which is a measure of the performance of the image forming apparatus, greatly drops.

Moreover, there is a problem in that the costs related to each of the steps required in the error-removal process increase the overall cost of the image forming apparatus.

SUMMARY OF THE INVENTION

The object of this invention is to provide an image forming apparatus and a method of estimating the amount of toner consumption that can more accurately estimate the amount of consumed toner for any kind of image.

This invention uses the following means for accomplishing the object mentioned above. That is, it is presumed that this invention is an image forming apparatus using electrophotographic process. Here, a printing-pixel-counting unit uses input image data to count the number of printing pixels. Also, an edge-counting unit uses the same input image data to count the edges being borders between the printing pixels and the blank pixels. Next, a toner-consumption-estimation unit calculates the amount of consumed toner based on the counted number of printing pixels and the number of edges.

With this construction, it is possible to accurately estimate even the amount of consumed toner that protrudes into and adheres to the blank pixels that are adjacent to the printing pixels, so it is possible to inexpensively but accurately estimate the toner density in the developer. Moreover, by estimating the toner density inside the developer and supplying toner as the toner density drops, it is possible to keep the toner density inside the developer at a constant level and thus make it possible to continue to output images having a constant image quality.

Also, the edge-counting unit can be constructed such that it independently and separately counts the number of edges in the main-scanning direction and the number of edges in the sub-scanning direction.

With this construction, even when the resolution in the main-scanning direction differs from the resolution in the sub-scanning direction, or even when the thickness of the dots on the edges in the main-scanning direction differs from the thickness of the dots on the edges in the sub-scanning direction it is still possible to accurately estimate the amount of consumed toner.

Furthermore, it is also possible to have a diagonal-section-counting unit that counts the diagonal points of contact between the printing pixels and the blank pixels, and to have the toner-consumption-estimation unit calculate the amount of consumed toner based on the counted number of printing pixels, number of edges, and number of diagonal-contact sections.

With this construction, it is possible to include the amount of consumed toner that adheres to the blank pixels that come in contact with the printing pixels in the estimated value, so it is possible to estimate the amount of consumed toner even more accurately.

Furthermore, it is also possible to have an isolated-pixel-counting unit that counts the isolated pixels that are surrounded completely by blank pixels, and to have the toner-consumption-estimation unit calculate the amount of consumed toner based on the number of counted number of printing pixels, number of edges, number of diagonal sections and number of isolated pixels.

With this construction, it is possible to include the decrease in the amount of consumed toner due to isolated pixels in the estimated value, so it is possible to estimate the amount of consumed toner even more accurately.

On the other hand, in an image forming apparatus that uses electrophotographic process, it is possible to have a window-formation unit that forms a window comprising a plurality of pixels from input image data and a comparison unit that compares the window obtained from the window-formation unit with a plurality of toner-consumption-estimation patterns. The toner-consumption-estimation patterns are stored beforehand in a specified memory unit. Next, the toner-consumption-estimation unit calculates the amount of consumed toner based on the toner-consumption-estimation pattern that matched in the aforementioned comparison and on the amount of toner consumption that corresponds to that pattern.

With this construction, the amount of consumed toner for each pattern is known in advance, so by comparing all of the toner-consumption-estimation patterns that correspond to the number of pixels of the window, it is possible to estimate the amount of consumed toner with high precision.

BRIEF DESCRIPTION OF THE DRAWINGS

FIG. 12A to FIG. 12D are drawings showing detection patters of the pattern-detection unit.

DESCRIPTION OF THE PREFERRED EMBODIMENTS

For a better understanding of this invention, the preferred embodiments of the invention will be explained below with reference to the supplied drawings. The embodiments described below are just detailed examples of the invention and do not limit the technical range of the invention. The image forming apparatus in the preferred embodiments described below is a printer, FAX receiving apparatus, etc.

(Embodiment 1)

The image forming apparatus of a first embodiment of the invention will be explained in detail with reference to FIG. 1 to FIG. 7.

Figure 1:
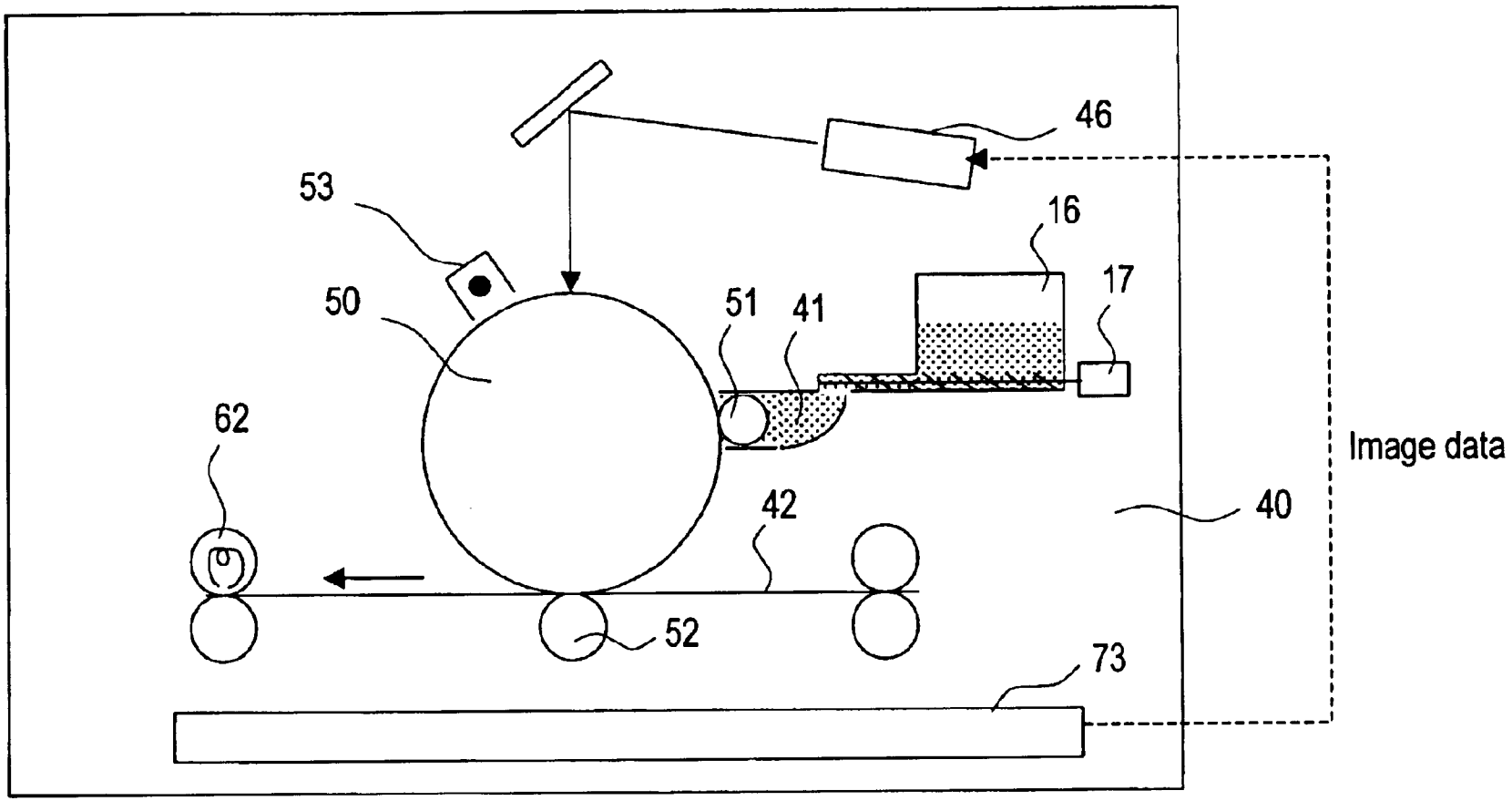
FIG. 1 is a schematic diagram of the construction of the mechanical parts of the image forming apparatus.

In FIG. 1, the image forming apparatus 40 emits a laser light from the exposure unit 46 based on image data that are sent from the printer-engine-control unit 73. The laser is irradiated on the photosensitive element 50 whose surface is uniformly charged by a charging unit 53. The surface electric potential of the part on the photosensitive element 50 that is irradiated by the laser changes, and a latent image is formed. Toner particles are caused to adhere to the latent image by the developing sleeve 51 in the developer 41, which is the developing unit, to form an image on the photosensitive element. The image that is formed is transferred to the paper 42 by a transfer roller 52, which is the transfer unit, to form an image on the paper. The toner on the paper 42 on which the image is formed is fixed by the fixation unit 62, and then the paper is output from the image forming apparatus.

Figure 2:
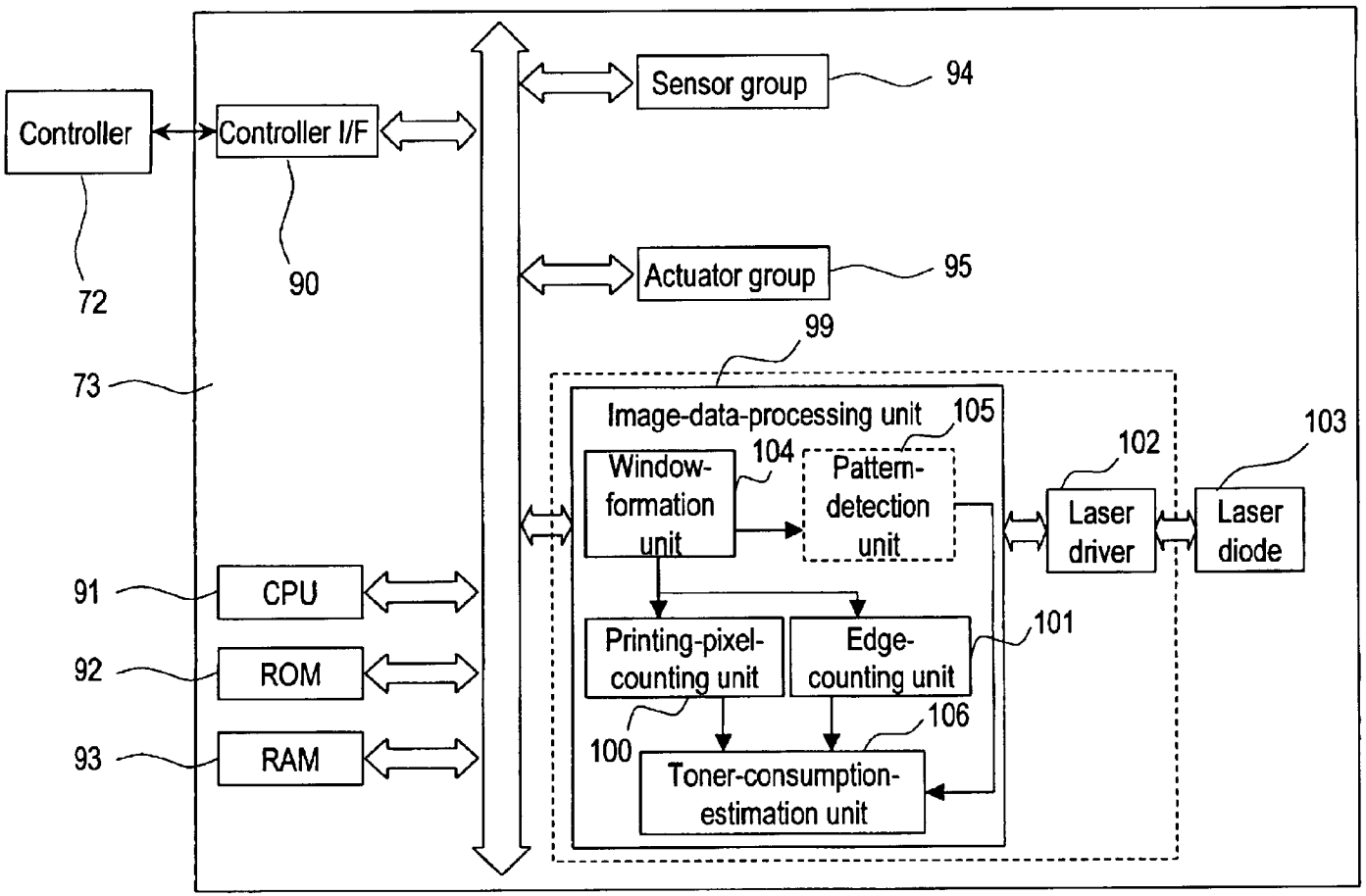
FIG. 2 is a schematic diagram of the printer-engine-control unit.

FIG. 2 is a drawing showing mainly a hardware construction of the printer-engine-control unit 73 of the image forming apparatus in FIG. 1. The construction and operation of the printer-engine-control unit 73 will be explained below.

In FIG. 2, a controller 72 receives image data from a computer or the like (not shown in the figure) via an external network, and generates printable image data by converting the format of that image data. A controller interface 90 receives the image data that are transferred in page units from the controller 72.

A CPU 91 controls the operation of the printer engine based on a program stored in ROM 92. RAM 93 is used as the work area for the CPU 91.

The sensor group 94 comprises a group of sensors and a group of sensor-output processing circuits. The CPU 91 obtains the output from the group of sensor-output processing circuits, making it possible to know the status of the image forming apparatus.

An actuator group 95 comprises the motors and solenoid clutches and their respective drivers that drive all of the elements of the image forming apparatus. The CPU 91 controls the actuator group 95 based on information obtained from the sensor group 94, and controls the entire operation of the image forming apparatus.

An image-data-processing unit 99 comprises a printing-pixel-counting unit 100 as the printing-pixel-detection unit, an edge-counting unit 101 as the edge-detection unit, and line memories (not shown in the figures) for a plurality of lines, and the toner-consumption-estimation unit 106 calculates the amount of consumed toner based on the number of printing pixels and number of edges. The method used for estimating the amount of consumed toner will be explained in detail later.

A laser driver 102 controls when to turn ON/OFF the laser diode 103, and turns ON/OFF the laser output based on whether the laser diode 103 is ON/OFF. The image-data-processing unit 99 can be installed as hardware, or can be provided as a program that is executed by the CPU 91. Also, the toner-consumption-estimation unit 106 can be installed in the image-data-processing unit 99 as hardware, or provided as a program that is executed by the CPU 91.

Before explaining the actual printing, the error between the amount of consumed toner calculated as described above and the actual amount of consumed toner will be explained in more detail.

In the case of using a laser printer having a resolution of 600 dpi, for example, when the line having a line width of 1 pixel is printed on the paper, the actual line that is output to the photosensitive element is thicker than the theoretical thickness of 0.042 mm at 600 dpi. This is because, in order that there be no gaps between pixels when filling in a solid image, the laser irradiates an area on the photosensitive element having a larger diameter than the area of the actual pixel. In other words, for a pixel to be printed, the laser irradiates the photosensitive element in a circular shape as shown by the broken line 306 in FIG. 3A. Therefore, when the toner actually adheres to the photosensitive element, the toner protrudes a little from the theoretical printing pixel, and naturally toner also adheres to part of the adjacent pixels that are not printed (hereafter, this state will be called the 'dot thickness'). That is, the amount Tr of toner that adheres to one pixel is expressed as the sum of the amount Td of toner that adheres to the printing pixel and the amount Te of toner that protrudes from the printing pixel. In other word, the area Sr to which the toner actually adheres at the time of printing the printing pixel is equal to the sum of the area Sd of the printing pixel and the area Se of portions to which the toner protruding from the area Sd adheres.

From this, the area Se of toner that protrudes from a pixel can be obtained by comparing the area (Sr) of the adhering toner found from the diameter of the laser beam for one pixel, and the area (Sd) of one pixel.

In this embodiment, the dot thickness of these printing pixels (amount that toner protrudes from the pixel) is added to the count value of the pixel signal for forming the pixel, so that the amount of consumed toner is estimated more accurately.

When there are adjacent printing pixels, the area of adhering toner does not increase along the edge of contact between the pixels (for example X in FIG. 3B), because the region of adhering toner includes this expanded portion even when the adhering toner protrudes from the pixel into the adjacent pixel. Therefore, it is not necessary to consider the dot thickness for edges between adjacent printing pixels.

However, when the adjacent pixel is not a printing pixel (it is a blank pixel), or in other words, when there is a boundary section (edge) between a printing pixel and a blank pixel (for example Y in FIG. 3B), the area of adhering toner increases by the amount that the toner protrudes from the pixel due to the dot thickness. This increase in area of adhering toner means that the amount of consumed toner increases by that amount. It is important to detect from these how many edge sections are included in the pixel when identifying the pixel signal. This invention counts (pixel count) the pixel signals for forming printing pixels, and at the same time counts (edge count) the number of edges for the 3 ×3 pixel image shown in FIG. 5A and FIG. 5B using two kinds of edge-detection filters (edge-detection filter FA for the main-scanning direction, FIG. 5A; and edge-detection filter FB for the sub-scanning direction, FIG. 5B), and by using both of these count values, performs estimation that is more highly precise than when simply counting the number of printing pixels.

The process of calculating the actual amount of consumed toner during actual printing will be explained below.

Here, the case of using a 600 dpi laser printer and printing on A4-sized paper is being considered. In this case, the total number of pixels for a sheet of paper is approximately 7,000×4,800=33,600,000 pixels.

The image data that are printed are input to the controller 72 via a network from a PC or the like (not shown in the figures). The controller 72 converts (rasterizes) the image data (or more correctly, commands and data groups that are given in page-description language) into two-value image data that can be printed by the image forming apparatus, and then transfers that image data in page units to the image-data-processing unit 99 via the controller interface 90.

Figure 4:
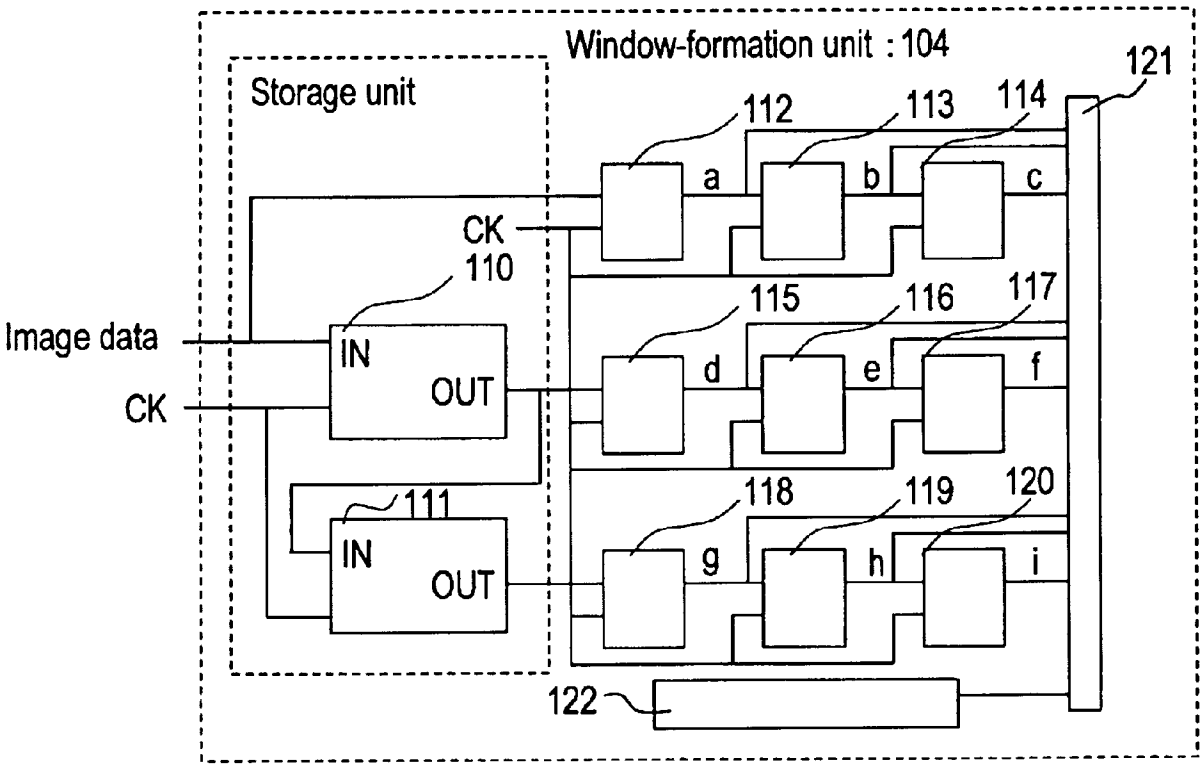
FIG. 4 is a drawing showing the construction of the storage unit and window-formation unit.
Figure 5A:
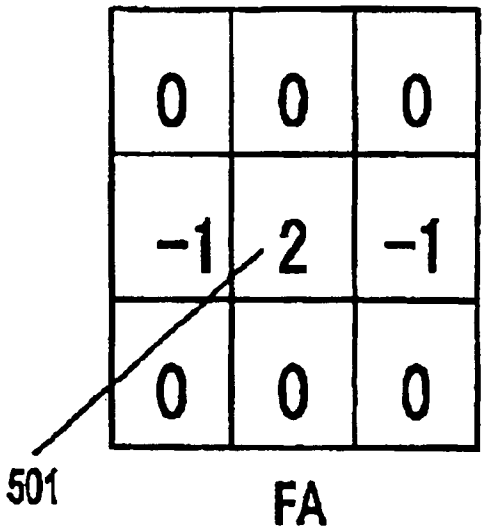
FIG. 5A and FIG. 5B are drawings showing the edge filters in the main-scanning direction and sub-scanning direction.
Figure 5B:
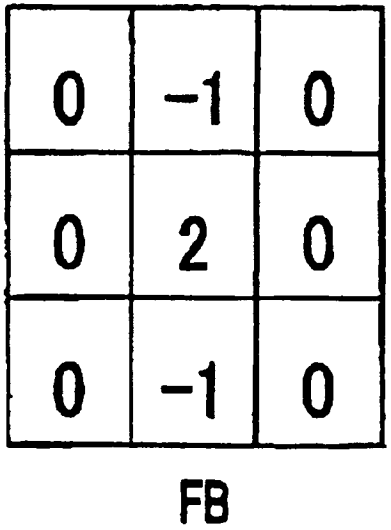

The image-data-processing unit 99 comprises the printing-pixel-counting unit 100, edge-counting unit 101, and window-formation unit 104 shown in FIG. 4. The window-formation unit 104 contains the storage unit that comprises the line memories.

First, the detailed processing of the method for calculating the edge-count value by the edge-counting unit 101 will be explained.

In the window-formation unit, first, line data for the first line of the input two-value image data are stored in synchronization with the video clock (CK) in the registers 112, 113 and 114 that are sequentially shifted. Also, similarly, the line data for the first line are stored in memory 110.

Next, after the first line of line data have been stored, the second line of line data are stored in registers 112, 113 and 114 that are sequentially shifted, and further stored in memory 110. Also, at the same time, the line data of the first line that are stored in memory 110 are stored in synchronization with the second line of line data and the clock CK in registers 115, 116 and 117 that sequentially shifted. At this time, the line data of the first line are stored in memory 111.

Similarly, when the second line of line data have been stored, the line data of the third line are stored in registers 112, 113 and 114 that are sequentially shifted, and further stored in memory 110. Also, at the same time, the line data of the second line that are stored in memory 110 are stored in synchronization with the third line of line data and the clock CK in registers 115, 116 and 117 that are sequentially shifted, and further stored in memory 111.

Figure 7:
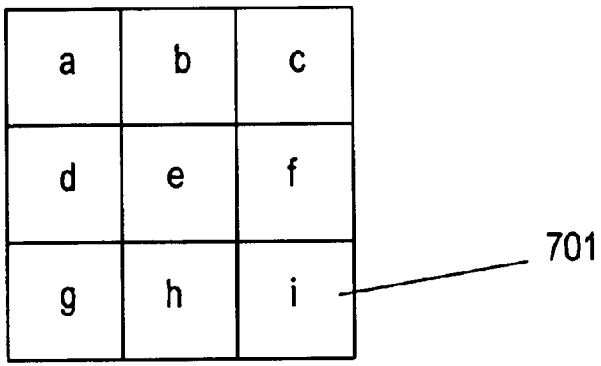
FIG. 7 is a drawing showing an image of the window configuration.

By repeating the process above, it is possible for the storage unit to obtain in order the 9 items of pixel data which constitute of the 3×3 window of the image data on one page. The image formed after obtaining the 9 items of pixel data of the window from the registers 112 to 120 (a to i) in FIG. 4 is shown in FIG. 7.

The nine items of pixel data are held in the register 121 at the timing of each latch clock generated by the clock generator 122. In this embodiment, the latch clock is the same as the clock CK, so the data in register 121 is updated for each pixel.

Of the 3 ×3 pixel window that is held in the register 121 of the window-formation unit, the edges in the main-scanning direction are counted by using the filter FA, and the edges in the sub-scanning direction are counted by using filter FB as shown in FIG. 5 for example.

Figures 6A, 6B:
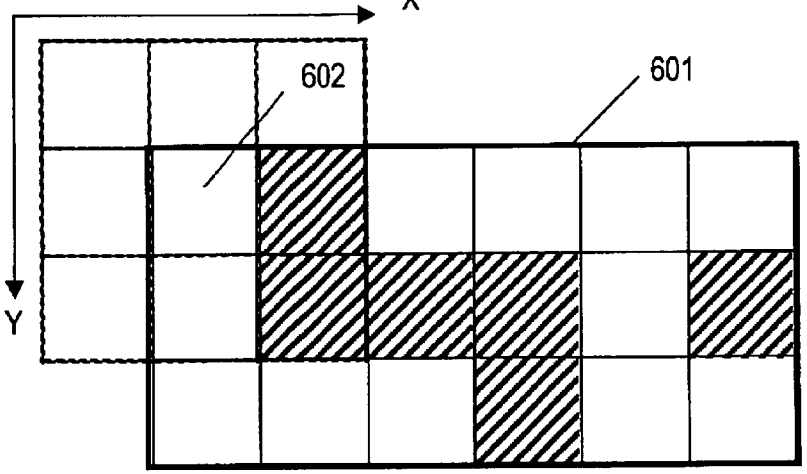
FIG. 6A and FIG. 6B are drawings showing a detailed example of using the edge filters.

That is, first, the reference pixel 602 of the image data 601 shown in FIG. 6A, is correlated with the calculation point 501 of filter FA. Next, the reference pixel 602 and the surrounding pixels are multiplied by the coefficient of filter FA and the results are totaled. The calculated value for reference pixel 602 is obtained in this way. For the reference pixel 602 (X, Y=1, 1) in FIG. 6A, the calculated value becomes −1.

By performing the above process in synchronization with the latch clock, it is possible to obtain the calculated values for each pixel of the image data. The calculated values for each pixel of the image data 601 is shown in FIG. 6B.

Of the calculated values, the number of edges in the main-scanning direction of the image data are counted by adding all of the values zero and greater. In the detailed example, the number of edges in the main-scanning direction becomes '8'. Also, by performing a similar process using filter FB the number of edges in the sub-scanning direction are counted, and in this detailed example, the number of edges in the sub-scanning direction is '8'. The edge count values calculated by the edge-counting unit 101 are stored in RAM 93.

The pixel count value that is calculated by the printing-pixel-counting unit 100 is just the sum of the number of pixels (printing pixels) to which toner is adhered, so a detailed explanation is omitted. The pixel count value that is calculated by the printing-pixel-counting unit 100 is also stored in RAM 93.

From the above processes, it is possible to obtain the pixel count value per page and the edge count value per page.

Moreover, in this embodiment, a more accurate estimated value for the amount of consumed toner is found, for example, from the equation (Eq. 1) below.

$$T=(Nd\times Sd+Ne\times Se)\times \underline{U}a \qquad \text{(Eq. 1)}$$

Here,

T: Amount of consumed toner

Nd: Pixel count value per page

Sd: Area per pixel

Ne: Edge count value per page

Se: Area of the protruding portion per edge

Ua: Amount of consumed toner per unit area.

Next, the toner-consumption-estimation unit 106 can find the estimated value for the amount of consumed toner by applying the values for Nd and Ne that are obtained from the above processing, and the values Sd, Se and a that are set beforehand for each machine to the equation above. The found estimated value is stored in the RAM 93, which is the memory. The values for Sd, Se and a are stored in advance in the memory unit (not shown in the figure) in the toner-consumption-estimation unit 106, for example.

Next, the CPU 91 sets the drive time for the hopper motor 17 based on the found estimated value for the amount of consumed toner, and by driving the hopper motor 17 toner is supplied from the hopper 16 to the inside of the developer. Depending on the amount of consumed toner, the amount of toner to be supplied is determined and supplied to the developer, so it is possible to control the toner density within a set range without the use of sensors.

By counting the pixel count value and edge count value independently as described above, it is possible to accurately estimate the amount of consumed toner, so it is possible to estimate the toner density in the developer cheaply and accurately. Also, by estimating the toner density in the developer, and supplying the toner according to the decrease in toner density, it is possible to maintain a constant level of toner density inside the developer and continuously output images having constant quality.

Figure 3A:
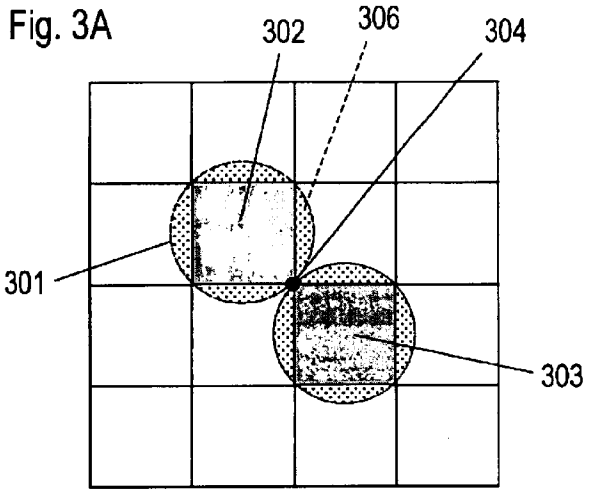
FIG. 3A to FIG. 3D are drawings showing the thickness of the dots.
Figure 3B:
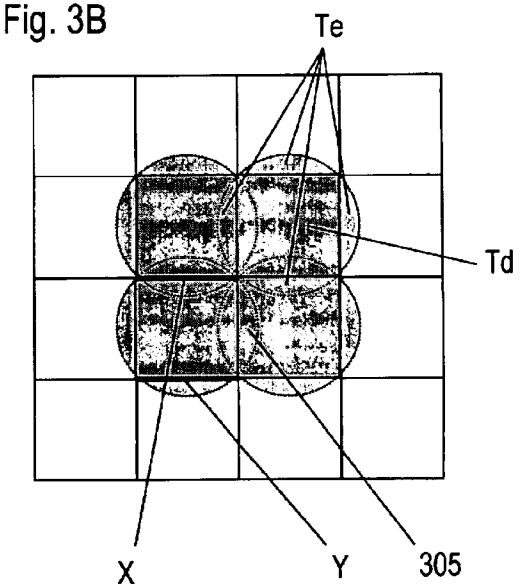
Figure 3C:
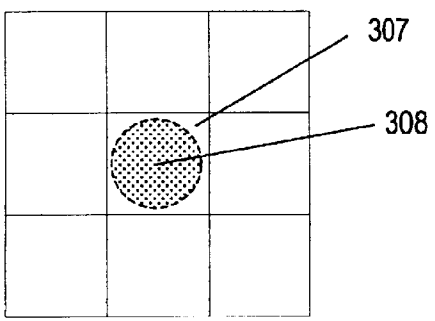
Figure 3D:
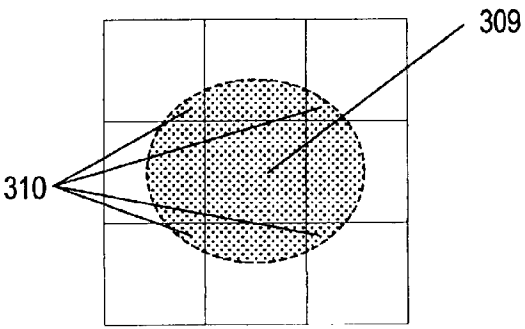

With this image forming apparatus, the resolution in the main-scanning direction may differ from the resolution in the sub-scanning direction as shown in FIG. 3D, or the dot thickness of the edges in the main-scanning direction may differ from the edges in the sub-scanning direction. In these cases as well, the number of edges in the main-scanning direction and in the sub-scanning direction are counted separately, so by multiplying each respective value with different coefficients, it is possible to estimate the amount of consumed toner even more accurately.

In this case, the more accurate estimated value for the amount of consumed toner can be found from the equation below (Eq. 2).

$$T=(Nd\times Sd+Ne1\times Se1+Ne2\times Se2)\times \underline{U}a \qquad \text{(Eq. 2)}$$

Here:

T: Amount of consumed toner

Nd1: Pixel count value per page

Sd: Area of one pixel

Ne1: Edge count value in the main-scanning direction per page

Se1: Area of the portion that protrudes per one edge in the main-scanning direction Ne2: Edge count value in the sub-scanning direction per page Se2: Area of the portion that protrudes per one edge in the sub-scanning direction Ua: Amount of consumed toner per unit area.

The first embodiment of the invention described above was explained for a single-color image forming apparatus, however, even in the case of a multi-color image forming apparatus, the embodiment can be applied to each color.

Moreover, in this first embodiment, the pixel count and edge count are performed in page units and the amount of consumed toner is estimated per page, however, it is also possible to perform the estimation in multiple-page units or for a fixed/variable space.

Furthermore, in this first embodiment, a window-formation unit was used in counting the edges, however, it is possible to count the number of edges using another method. In that case, it is not always necessary to have the window-formation unit.

(Embodiment 2)

In the first embodiment, a method of estimating the amount of consumed toner taking into consideration the dot thickness in the main-scanning direction and sub-scanning direction was described. However, as shown in FIG. 3D, depending on the apparatus, there are cases when the toner that is to adhere to the pixel 309 protrudes from the pixel diagonally from the corners 310. In this kind of situation, errors occur even when using the method of the first embodiment.

Therefore, in this second embodiment, a method of estimating the amount of consumed toner based on the location of the printing pixels in the windows will be explained. Explanations of parts that are common with the first embodiment will be omitted.

In this embodiment, the image-data-processing unit 99 comprises a pattern-detection unit 105 instead of the printing-pixel-counting unit 100 and edge-counting unit 101. The pattern-detection unit 105 comprises 2 to the 9th power (512) comparison circuits, and similarly 512 toner-consumption-estimation patterns, however, for better understanding only four will be used in this explanation. Here the number 512 is the numerical value for covering all of the print patterns possible within the 3×3 pixels, and by performing a rotating process on the toner-consumption-estimation pattern, for example, it is possible to reduce the amount by about ¼.

Figure 8:
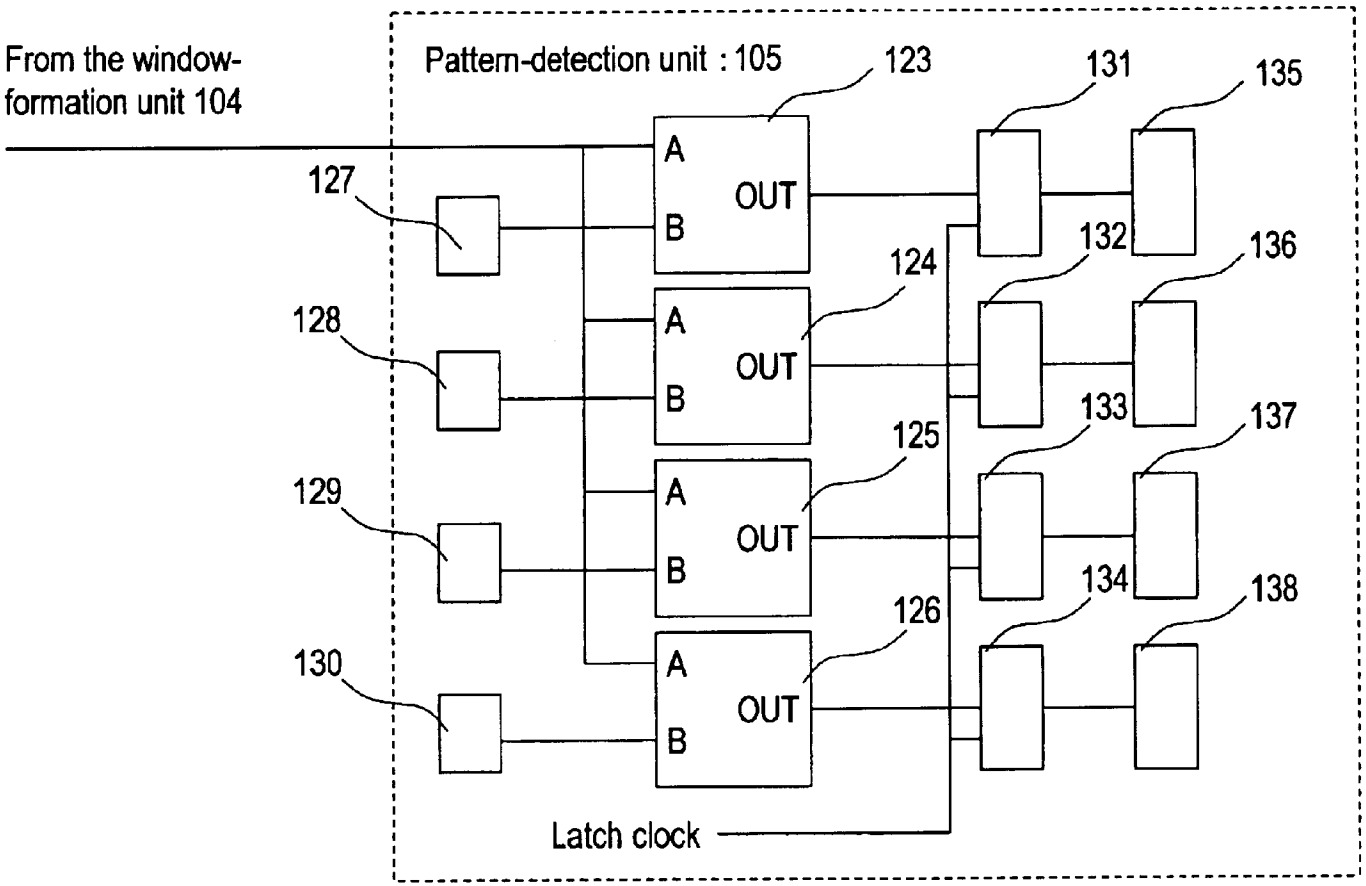
FIG. 8 is a drawing showing the construction of the pattern-detection unit.
Figure 9:
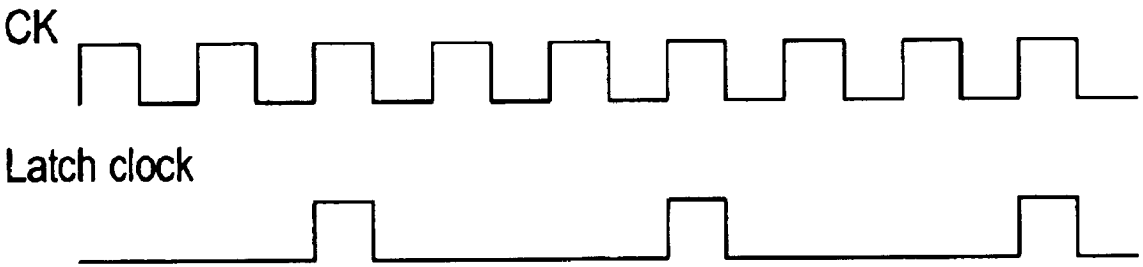
FIG. 9 is a drawing showing the timing of the latch clock.

In the input A of the comparison circuits 123 to 126 in the pattern-detection unit 105 shown in FIG. 8, the nine items of pixel data of the 3×3 window, which is output from the register 121 of the window-formation unit 104, are input. However, the intervals, in which the nine items of pixel data are input, are three times the clock CK, and it can be adjusted using the clock generator, for example, by setting the latch clock to ⅓ the clock CK as shown in FIG. 9. In other words, the nine items of pixel data that are output from the window-formation unit 104 are input to the pattern-detection unit 105 one window at a time and not one pixel at a time.

Figure 10B:
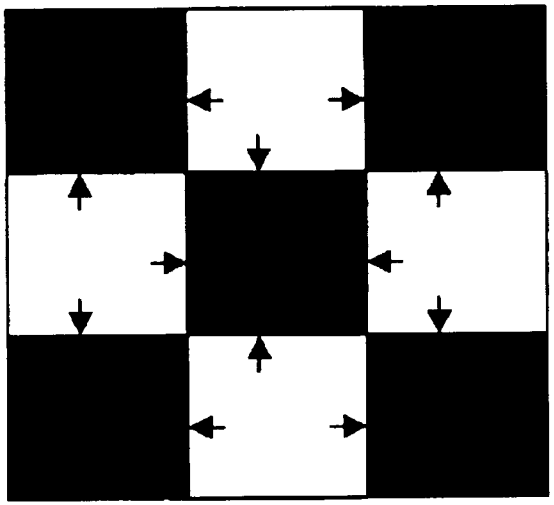
FIG. 10A and FIG. 10B are drawings showing examples of pattern construction.
Figure 10A:
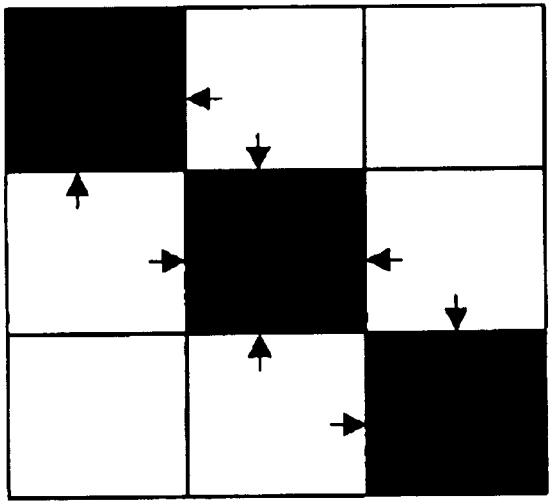

The registers 127 to 130 are connected respectively to the input B of the comparison circuits 123 to 126, and the stored toner-consumption-estimation patters that are input to the registers. FIG. 10A and FIG. 10B show two examples of toner-consumption-estimation patterns. Naturally, there are 512 types of these non-redundant toner-consumption-estimation patterns. The arrows in the figures indicated the edge sections, and the dot thickness occurs near these areas.

The comparison circuits 123 to 126 output a '1' when the window input at input A, and the toner-consumption-estimation pattern input at input B match, and the output values are stored in the registers 131 to 134. Also, the values output according to the latch clock are added to the counters 135 to 138.

For example, after one page of image data have been output, the toner-consumption-estimation unit 106 references the values in the counters 135 to 138 to find how many of the windows contained on the one page matched the toner-consumption-estimation patterns. Next, the toner-consumption-estimation unit 106 multiplies the amounts of consumed toner that were found in advance for each toner-consumption-estimation pattern by the corresponding counter values, and adds all of the multiplication results. By doing this, it is possible to accurately calculate the amount of consumed toner while taking into consideration the dot thickness in the corners 310 as shown in FIG. 3D.

In other words, in this second embodiment, since the amounts of consumed toner are known in advance for each respective pattern, it is possible to estimate the amount of consumed toner with high accuracy by making a comparison with all of the toner-consumption-estimation patterns that correspond to the number of pixels of the windows.

(Embodiment 3)

In the first embodiment, a method of estimating the amount of consumed toner taking into consideration the dot thickness in the main-scanning direction and sub-scanning direction was described. Also, in the second embodiment, a method of estimating the amount of consumed toner taking into consideration the dot thickness in the diagonal corners was described. However, in the case of an isolated pixel as shown in FIG. 3C, the amount toner that is consumed is less than in the case of a normal pixel. In this case, errors will occurs when using the methods described in the first and second embodiments.

Figure 11B:
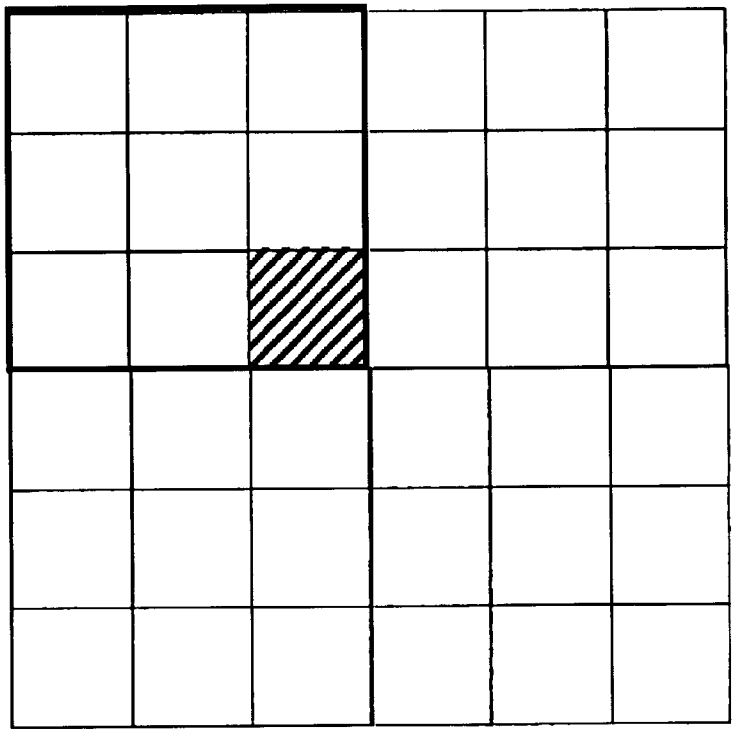
FIG. 11A and FIG. 11B are drawings showing detailed examples when determining isolated pixels.
Figure 11A:
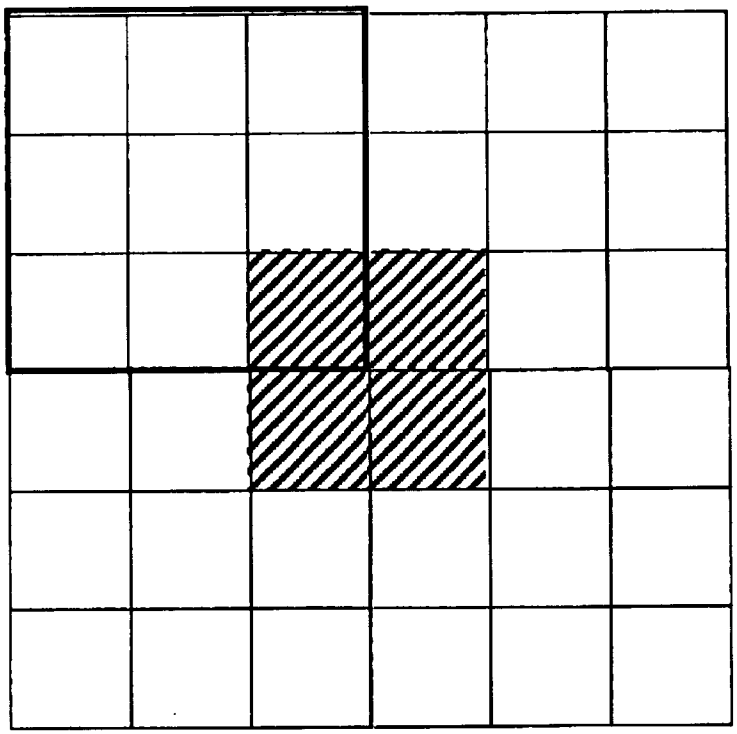

That is, with the art described in the first embodiment, the number of edges counted for the isolated pixel is 4, so the amount of consumed toner that is calculated is greater than the actual amount. Also, in the case of the second embodiment, when it is detected that the portion of the pixel i shown in FIG. 7 is a printing pixel, it is not possible to determine whether the pixel is an isolated pixel as shown in FIG. 11A, or is an isolated pixel as shown in FIG. 11B. Therefore, error occurs in the estimation of the amount of consumed toner.

Therefore, this third embodiment adds a pattern a pattern-detection unit to the construction of the first embodiment. However, the pattern-detection unit of this third embodiment is different than that of the second embodiment in that it comprises a diagonal-section-counting unit and an isolated-pixel-counting unit.

The pattern-detection unit of this third embodiment obtains the nine items of pixel data of the 3 ×3 window from the window-formation unit 104, and determines whether or not that pixel data corresponds to any of four patterns. These four patterns are shown in FIG. 12A to FIG. 12D.

The pattern A shown in FIG. 12A determines that the four items of image data correspond to a, b, d and e of the window; the pattern B shown in FIG. 12B determines that the four items of image data correspond to b, c, e and f in the window; pattern C shown in FIG. 12C determines that the four items of image data correspond to the d, e, g and h in the window; and pattern D shown in FIG. 12D determines that the four items of image data corresponding to e, f, h and i in the window.

The judgment determines that the portion corresponding to e is '1' (printing pixel), and that all other portions are '0' (blank pixels). The judgment can be performed simply by using an AND circuit, for example, so details will be omitted.

In the case that it corresponds to the patterns, the diagonal-section-counting unit adds '1' to the diagonal-section-count value. However, when it corresponds to all of the four patterns, the isolated-pixel-counting unit adds '1' to the isolated-pixel-count value, however the diagonal-section-counting unit does not add to the diagonal-section-count value. The above process is performed in addition to the processing described for the first embodiment. The detection interval is based on the clock CK.

Figure 13B:
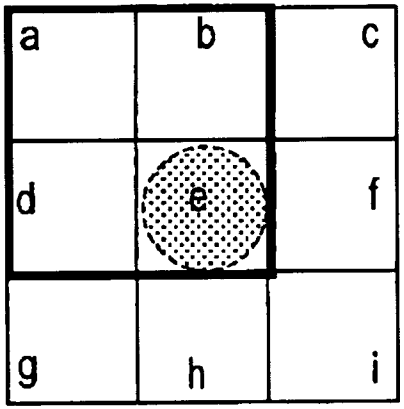
FIG. 13A and FIG. 13B are drawings showing a detailed example of the process of the pattern-detection unit.
Figure 13A:
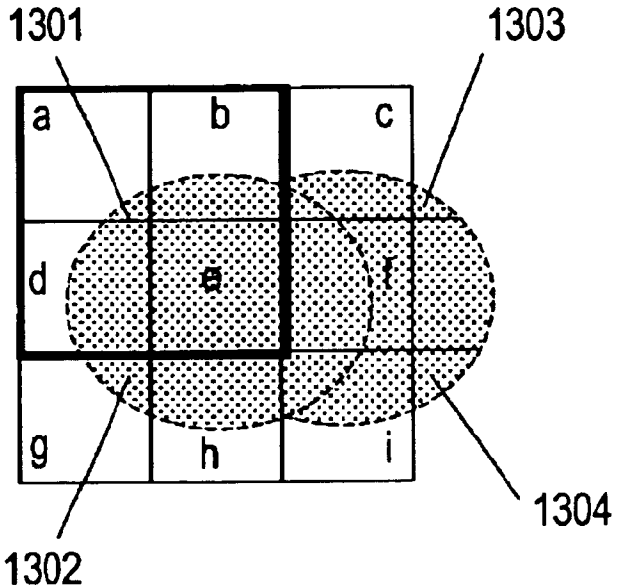

In the example shown in FIG. 13A, the pattern-detection unit process the image data of the portions corresponding to e and f, which are printing pixels, and when the reference pixel is e, pattern A and pattern C correspond, so the diagonal-section-count value becomes 2. In other words, the sections 1301 and 1302 of the diagonally adjacent pixels are counted. Furthermore, when f is the reference pixel, pattern B and pattern D correspond, so 2 are add to the diagonal-section-count value and it becomes 4. Here, the sections 1303 and 1304 of the diagonally adjacent pixels are counted. The ends of the image data are processed as blank pixels.

Moreover, in the case when the pattern-detection unit process image data that is an isolated pixel as shown in FIG. 13B, when the reference pixel is e, all of the patterns A to D correspond, so the diagonal-section-count value becomes 0, and the isolated-count value becomes 1.

Using the diagonal-section-count value and isolated-pixel-count value that were calculated by the pattern-detection unit, and the pixel-count value, edge-count value in the main-scanning direction and edge-count value in the sub-scanning direction that were calculated in the first embodiment, it is possible to estimate the value of the amount of consumed toner even more accurately by using the equation (Eq. 3) below.

$$T=((Nd-Ne4)\times Sd+(Ne1-2\times Ne4)\times Se1+(Ne2-2\times Ne4)\times Se2+Ne3\times Se3+Ne4\times Se4)\times \underline{U}a \quad \text{(Eq. 3)}$$

Here:

T: Amount of consumed toner

Nd: Pixel count value per page

Sd: Area for one pixel

Ne1: Edge-count value in the main-scanning direction per page

Se1: Area of the portion protruding from one edge in the main-scanning direction Ne2: Edge-count value in the sub-scanning direction per page Se2: Area of the portion protruding from one edge in the sub-scanning direction Ne3: Diagonal-section-count value per page Se3: Area of the portion protruding per one diagonal section Ne4: Isolated-pixel-count value per page Se4: Area for one isolated pixel Ua: Amount of consumed toner per unit area.

As described above, the isolated pixels are efficiently determined by the pattern-detection unit, and the dot thickness is also counted is in the diagonal direction. In this way, it is possible to accurately estimate the amount of consumed toner while considering the dot thickness in the main-scanning direction, sub-scanning direction and diagonal direction, and the decrease in consumed toner for isolated pixels. As a result, it becomes possible to omit some of the units required for removing errors, and thus it is possible to make the entire image forming apparatus more cost effective.

Moreover, even in the case of performing processing to remove error, it is possible to greatly reduce the frequency at which it is performed, so it is possible to improve the printing speed of the image forming apparatus.

This third embodiment is constructed so as to remove both the error in the diagonal sections and error due to isolated pixels, however, in the case of an image-processing unit in which the area of adhered toner does not decrease even in the case of an isolated pixel, it is not absolutely necessary to count the isolated pixels. Needless to say, construction that does not count the isolated pixels and that doesn't count the diagonal sections is also possible.

Furthermore, in this third embodiment, a window-formation unit was used to count the edges, however, the edges can be counted using some other method. In that case, the window-formation unit is not absolutely necessary.

[Effect of the Invention]

As described above, with this invention, it is possible to accurately estimate the amount of consumed toner, and thus it is possible to cheaply and accurately estimate the toner density in the developer. Also, by estimating the toner density in the developer and supplying toner as the toner density decreases, it is possible to maintain the toner density in the developer at a constant level, and to continuously output images with constant image quality.

Furthermore, the number of edges are counted separately in both the main-scanning direction and sub-scanning direction, so even in the case where the resolution in the main-scanning direction differs from that in the sub-scanning direction, or in the case where the dot thickness of the edges in the main-scanning direction differs from that in the sub-scanning direction, it is possible to even more accurately estimate the amount of consumed toner.

Also, since the amount of consumed toner is already know for various patterns, it is possible to estimate the amount of consumed toner with high precision by comparing the pixels of the window with all of the corresponding toner-consumption-estimation patterns.

Moreover, a pattern-detection unit efficiently determines whether there are isolated pixels and counts the dot thickness in the diagonal direction. This makes it possible to accurately estimate the amount of consumed toner while taking into consideration the dot thickness in the main-scanning direction, sub-scanning direction and diagonal direction as well as any decrease in the amount of consumed toner due to isolated pixels. As a result, it becomes possible to omit units necessary for performing error-removal processing, and to make the entire image forming apparatus more cost effective.

Moreover, even in the case of performing processing to remove error, it is possible to greatly reduce the frequency at which it is performed, so it is possible to improve the printing speed of the image forming apparatus.

What is claimed is:

1. An image forming apparatus using electrophotographic process, comprising:

a printing-pixel-counting unit operable to count from input image data the number of printing pixels to which toner should be adhered;

an edge-counting Unit operable to count from the input image data the number of edges being boundaries between the printing pixels and blank pixels to which toner should not be; and a toner-consumption-estimation unit operable to calculate the amount of consumed toner based on said number of counted printing pixels and said edges.

2. The image forming apparatus of claim 1 wherein said edge-counting unit separately counts the number of edges in a main-scanning direction and the number edges in a sub-scanning direction.

3. The image forming apparatus of claim 1 further comprising:

a diagonal-section-counting unit operable to count blank pixels that come in point contact with said printing pixels as diagonal sections; and wherein said toner-consumption-estimation unit calculates the amount of consumed toner based on said counted number of printing pixels, number of edges and number of diagonal sections.

4. The image forming apparatus of claim 3 further comprising:

an isolated-pixel-counting unit operable to count isolated pixels that are surrounded completely by blank pixels; and wherein said toner-consumption-estimation unit calculates the amount of consumed toner based on said counted number of printing pixels, number of edges, number of diagonal sections and number of isolated pixels.

5. The image forming apparatus of claim 1 wherein said edge-counting unit counts the adjacent sides of the printing pixels and the blank pixels, which are adjacent to the printing pixels, as edges.

6. A toner-consumption-estimation method for an image forming apparatus using electrophotographic process, comprising:

a printing-pixel-counting step of counting from input image data the number of printing pixel to which toner should be adhered;

an edge-counting step of counting from the input image data the number of edges being boundaries between printing pixels and blank pixels to which toner should not be; and a toner-consumption-estimation step of calculating the amount of consumed toner based on said number of counted printing pixels and said edges.

7. The toner-consumption-estimation method of claim 6 wherein said edge-counting step separately counts the number of edges in a main-scanning direction and the number edges in a sub-scanning direction.

8. The toner-consumption-estimation method of claim 7 further comprising:

a diagonal-section-counting step of counting blank pixels that come in point contact with said printing pixels as diagonal sections; and wherein said toner-consumption-estimation step calculates the amount of consumed toner based on said counted number of printing pixels, number of edges and number of diagonal sections.

9. The toner-consumption-estimation method of claim 8 further comprising:

an isolated-pixel-counting step of counting isolated pixels that are surrounded completely by blank pixels; and wherein said toner-consumption-estimation step calculates the amount of consumed toner based on said counted number of printing pixels, number of edges, number of diagonal sections and number of isolated pixels.

10. The toner-consumption-estimation method of claim 6 wherein said edge-counting step counts the adjacent sides of the printing pixels and blank pixels, which are adjacent to the printing pixels, as edges.

11. An image forming apparatus using electrophotographic process, comprising:

a window-formation unit operable to form a window from input image data, said window containing a specified number of pixels that are connected in both a main-scanning direction and a sub-scanning direction;

a first memory unit operable to store a plurality of toner-consumption-estimation patterns that have a plurality of printing pixels and/or blank pixels that correspond to said window;

a second memory unit operable to store the amount of consumed toner for each of said plurality of toner-consumption-estimation patterns;

a comparison unit operable to compare the window obtained from said window-formation unit and said plurality of toner-consumption-estimation patterns; and a toner-consumption-estimation unit operable to calculate the amount of consumed toner based on toner-consumption-estimation patterns that matched in said comparison, and on said amounts of consumed toner that corresponds to those toner-consumption-estimation patterns.

12. The toner-consumption-estimation apparatus of claim 11 wherein amounts of consumed toner for each toner-consumption-estimation pattern that are stored in said second memory unit is calculated such that it includes the area of the printing pixels and the area of the blank pixels adjacent to the printing pixels to which toner should be adhered.

13. A toner-consumption-estimation method for an image forming apparatus that uses electrophotographic process, comprising:

a window-formation step of forming a window from the input image data, said window containing a specified number of pixels that are connected in both a main-scanning direction and a sub-scanning direction;

a comparison step of comparing the window obtained from said window-formation step and plurality of toner-consumption-estimation patterns that consist of a plurality of printing pixels and/or blank pixels corresponding to said window; and a toner-consumption-estimation step of calculating the amount of consumed toner based on toner-consumption-estimation patterns that matched in said comparison step, and on amounts of consumed toner stored beforehand and that corresponds to those toner-consumption-estimation patterns.

* * * * *